United States Patent [19]

Brodecki et al.

[11] Patent Number: 4,965,556

[45] Date of Patent: Oct. 23, 1990

[54] COMBUSTION PRODUCTS DETECTOR HAVING SELF-ACTUATED PERIODIC TESTING SIGNAL

[75] Inventors: James Brodecki, Darien; William Tanguay, Downers Grove; Dale Fiene, Addison, all of Ill.

[73] Assignee: Seatt Corporation, Downers Grove, Ill.

[21] Appl. No.: 165,611

[22] Filed: Mar. 8, 1988

[51] Int. Cl.[5] ..... G08B 17/10

[52] U.S. Cl. ..... 340/628; 340/514; 340/515; 340/516

[58] Field of Search ..... 340/628, 514, 515, 516, 340/629, 630; 250/573-575, 577; 356/439, 438

[56] References Cited

U.S. PATENT DOCUMENTS

| | | | |
|---|---|---|---|
| 3,801,972 | 4/1974 | Ho Kim | 340/630 |
| 4,088,986 | 5/1978 | Boucher | 340/630 |
| 4,266,218 | 5/1981 | Kadash | 340/630 |
| 4,321,466 | 3/1982 | Mallory | 340/630 |
| 4,388,615 | 6/1983 | Ford et al. | 340/636 |
| 4,481,502 | 11/1984 | Dawson | 340/516 |
| 4,595,914 | 6/1986 | Siegel | 340/516 |

FOREIGN PATENT DOCUMENTS

| | | | |
|---|---|---|---|
| 0147013 | 3/1981 | German Democratic Rep. | 340/516 |

*Primary Examiner*—Joseph A. Orsino
*Assistant Examiner*—Jill Jackson
*Attorney, Agent, or Firm*—Niro,Scavone,Haller & Niro, Ltd.

[57] ABSTRACT

Disclosed is an improved combustion products smoke alarm that includes an electronic circuit which automatically tests the detector's operation repetitively at periodic intervals, or periodically sounds the detector's alarm to remind the occupant to manually test the detector's operation. In the preferred embodiment, this periodic testing or reminding occurs at weekly intervals. Thus, occupants living about such a smoke alarm, after experiencing this repetitive sounding of the detector's alarm for some time, will come to anticipate its sounding and notice its absence if the smoke alarm becomes inoperative.

32 Claims, 1 Drawing Sheet

FIG. 1
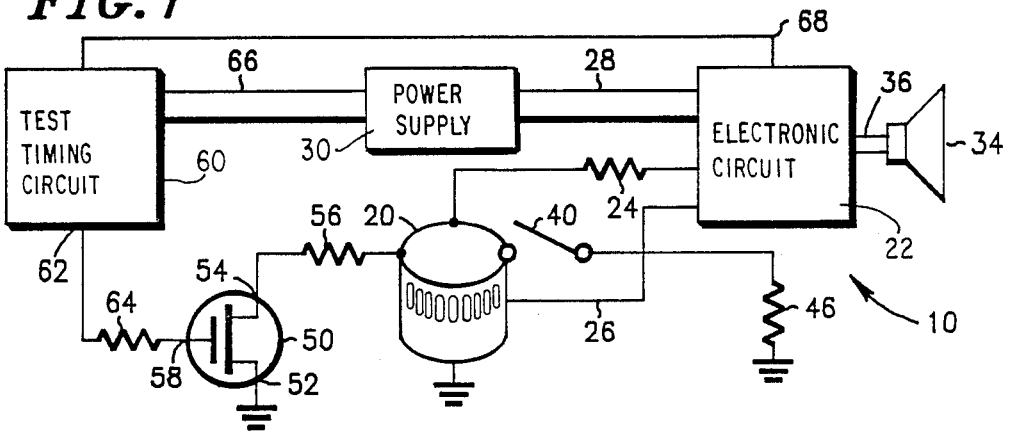
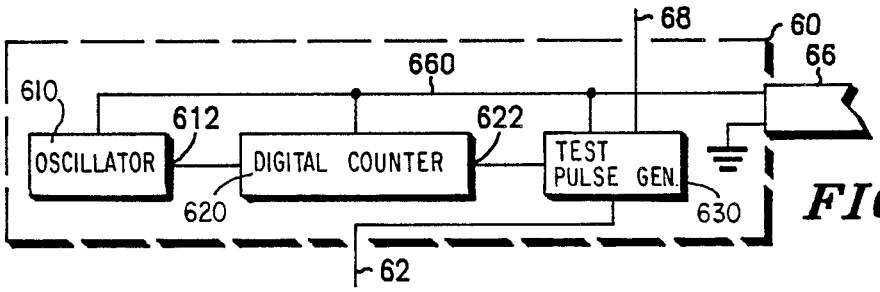
FIG. 2
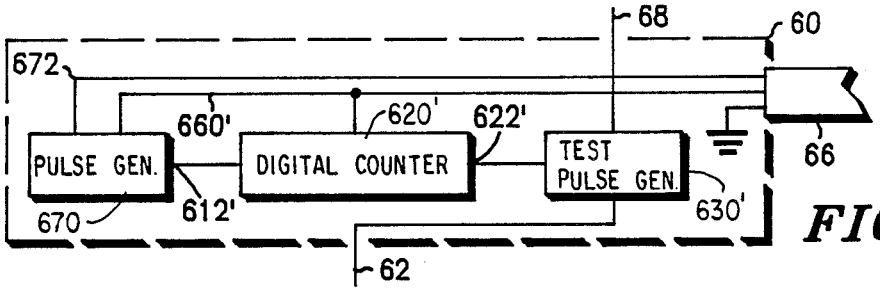
FIG. 3
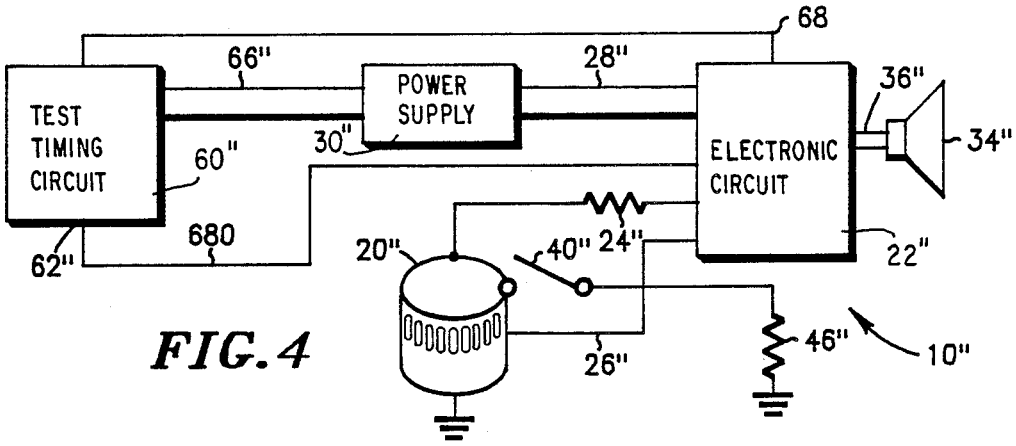
FIG. 4

COMBUSTION PRODUCTS DETECTOR HAVING SELF-ACTUATED PERIODIC TESTING SIGNAL

BACKGROUND OF THE INVENTION

1. Field of the Invention

The present invention relates generally to combustion products smoke alarms and, more particularly, to means for automatically self-testing such alarms.

2. Description of the Prior Art

Smoke alarms, also known as ionization smoke alarms and photoelectric smoke alarms, are extremely effective at reducing deaths from fires. In an effort to maintain this effectiveness over many years, such smoke alarms include a manual test switch. Manufacturers and fire officials recommend that occupants test the smoke alarm's operation periodically, e.g. weekly, by pressing the manual test switch and observing if the smoke alarm produces a perceptible indication that an excessive concentration of combustion products exists about its combustion products sensor, usually by sounding an audible alarm. In addition, battery powered models of smoke alarms also include a battery power monitoring circuit that automatically sounds the audible alarm with a unique sound if a low battery power condition occurs.

The manual test switch included in smoke alarms tests them by electronically simulating the presence of combustion products about the sensor. For example, pressing the manual test switch may electrically connect an impedance in parallel with an ionization chamber included in the smoke alarm. Connecting the impedance in parallel with the ionization chamber changes the voltage thereacross so the electrical signal produced by the ionization chamber simulates that which the chamber produces if an excessive concentration of combustion products are present. Such manual test switches are disclosed in U.S. Pat. Nos. 4,097,850, 4,246,572, and 4,595,914.

In addition to a manual test switch, U.S. Pat. No. 4,595,914 further discloses a smoke alarm that periodically tests whether the sensitivity of the ionization chamber lies within a predetermined range between a minimum and a maximum sensitivity. This patent teaches that the automatic sensitivity test should be performed approximately every minute. Another significant aspect of this patent is that the alarm is inhibited during automatic testing and that it sounds only after the test is completed and only if the ionization chamber's sensitivity is greater than the maximum allowed sensitivity or lower than the minimum allowed sensitivity.

Despite the effectiveness of such smoke alarms at reducing deaths caused by fire, unfortunately, due primarily to dead or missing batteries it is estimated that presently one-fourth to one-third of the installed smoke alarms are not operating. If this trend continues, it has been estimated that by 1994 one-half of all fires in dwellings having alarms will go undetected because the alarms are inoperative. Obviously the preceding situation would not exist if every smoke alarm's operation was tested periodically, e.g. weekly as recommended by their manufacturers and fire officials, and non-functional alarms repaired or replaced. Consequently, the primary cause for this situation is occupant neglect in failing to periodically test the smoke alarm.

There are several reasons why such neglect occurs. First, most smoke alarms are fastened to a ceiling which is typically eight feet above the floor. Consequently pressing the test switch requires either getting a chair or ladder on which to stand while reaching the alarm, or getting a stick with which to push the test switch. This extra effort inclines the owners to neglect testing and may render testing physically impossible for elderly or disabled individuals. Furthermore, since in the absence of a fire there is no readily apparent difference between an operable and an inoperable smoke alarm, occupants forget that they are installed and need to be tested periodically soon after they are installed. For battery powered smoke alarms which produce a sound or signal to indicate a low power condition, another reason for occupant neglect is the rarity of low battery power events. Due to the rarity of low battery power events, some occupants are unfamiliar with the meaning of the sound or signal produced by the smoke alarm when such a condition occurs.

SUMMARY OF THE PRESENT INVENTION

An object of the present invention is to provide an improved smoke alarm which retains its effectiveness over many years.

Another object of the present invention is to provide an improved smoke alarm that remains effective through timely maintenance.

Another object is to provide a smoke alarm whose effectiveness is more likely to be maintained.

Another object is to provide an improved smoke alarm that periodically tests its operation automatically.

Another object is to provide an improved smoke alarm that reminds occupants of its presence.

Another object is to provide an improved smoke alarm whose inoperativeness is more likely to be recognized by occupants.

Another object is to provide an improved smoke alarm that occupants are more likely to test for operativeness.

Briefly, the present invention includes an electronic switch connected to the sensor of a combustion products smoke alarm. When this electronic switch is activated by an electrical signal it tests the operation of the smoke alarm in the same way as the manual switch presently included therein. To activate this electronic switch, the smoke alarm of the present invention also includes a test timing circuit which periodically generates an electronic testing pulse that is transmitted to the electronic switch. In another embodiment, this electronic testing pulse merely activates an electronic circuit to sound the alarm's alarm rather than testing the smoke alarm's operation. Thus in either of these two embodiments, when the smoke alarm is operating properly in accordance with the present invention, the alarm sounds at periodic intervals for a brief interval in response to the testing pulses generated by the test timing circuit.

In the preferred embodiments of the present invention, the testing pulses occur precisely at weekly intervals. Consequently, over a period of time while the smoke alarm operates properly the occupants of the building where it is installed will come to anticipate the regular sounding of the alarm at the preset time as the smoke alarm performs its automatic self-testing operation. Thus, if the smoke alarm ceases to operate properly the occupants will notice the alarm's failure to sound its alarm at its regular time and thereby be reminded to investigate and remedy the cause for that failure.

In addition, the automatic test signal will remind the occupants to test other smoke alarms in the building which are not equipped with the invention disclosed herein, or which are in locations where the automatic test signal may not normally be heard.

These and other features, objects and advantages will either be discussed or will, no doubt, become apparent to those of ordinary skill in the art after having read the following detailed description of the preferred embodiments as illustrated in the various drawing figures.

BRIEF DESCRIPTION OF THE DRAWINGS

FIG. 1 is a functional-type block diagram depicting a combustion products smoke alarm in accordance with the present invention having an electronic switch for testing the alarm's operation and a test timing circuit for automatically activating that switch;

FIG. 2 is a functional-type block diagram depicting a first embodiment of the test timing circuit of FIG. 1 in which testing pulses are generated by the test timing circuit in response to periodic timing pulses produced by a crystal controlled oscillator;

FIG. 3 is a functional-type block diagram depicting a second embodiment of the test timing circuit of FIG. 1 in which the smoke alarm's power supply is energized by alternating current electrical power and the testing pulses are generated by the test timing circuit in response to periodic timing pulses whose frequency is controlled by that alternating current electrical power source; and FIG. 4 is a functional-type block diagram depicting an alternative embodiment combustion products smoke alarm in accordance with the present invention having a test timing circuit for automatically sounding the audible alarm thereby reminding the occupants that it is time to test the smoke alarm's operation by pressing its manual test switch.

DETAILED DESCRIPTION OF THE PREFERRED EMBODIMENTS

FIG. 1 depicts a combustion products smoke alarm referred to by the general reference number 10, that incorporates the present invention. The smoke alarm 10 includes a sensor 20 that produces an electronic signal which indicates the concentration of combustion products present in the atmosphere surrounding the sensor 20. A bias voltage is applied to one side of the sensor 20 from an electronic circuit 22 through a bias resistor 24 while the other side of the sensor 20 is connected to circuit ground of the smoke alarm 10. A sensing electrode within the sensor 20 (not depicted in FIG. 1) is connected via a sensing lead 26 to the electronic circuit 22. Thus the sensor 20 provides the electronic circuit 22 with an electrical signal that indicates the concentration of combustion products about the sensor 20. The electronic circuit 22 is electrically energized by direct current power supplied to it through power leads 28 from a power supply 30. An audible alarm 34 receives an electrical output signal from the electronic circuit 22 via alarm output leads 36. For a more thorough discussion of the sensor 20, its operation, its connection to the electronic circuit 22, and the operation of that circuit, see presently pending U.S. patent application Ser.No. 07/022,099 filed Mar. 5, 1987 and assigned to the same assignee as the present application which is incorporated herein by reference.

When operating properly, the electronic circuit 22 of the smoke alarm 10, energized by the power supply 30, responds to an electrical signal indicative of an predetermined excessive concentration of combustion products about the sensor 20 by producing an output signal that causes the audible alarm 34 to sound. If a normal concentration of combustion products exists about the sensor 20, the audible alarm 34 of the smoke alarm 10 remains silent. If the power supply 30 ceases to provide direct current electrical power for energizing the electronic circuit 22, then the audible alarm 34 also remains silent even if an excessive concentration of combustion products exists about the power supply 30.

To test whether the smoke alarm 10 is operating properly, the smoke alarm 10 includes a manual test switch 40 which may be pressed to contact the sensor 20 or a suitable circuit connection to the sensor. The manual test switch 40 is connected to the electrical circuit ground of the smoke alarm 10 by a resistor 46. Pressing the manual test switch 40 causes the electronic signal produced by the sensor 20 to simulate an excessive concentration of combustion products about the sensor 20. Upon simulating an excessive concentration of combustion products about the sensor 20, a normally operating smoke alarm 10 sounds the audible alarm 34. If the smoke alarm 10 is not operating properly, perhaps because the power supply 30 fails to energize the electronic circuit 22, the audible alarm 34 will not sound when the manual test switch 40 is pressed and contacts the sensor 20.

The power supply 30 included in the smoke alarm 10 may be one of two different types. One type of power supply 30 is an ordinary battery which electro-chemically produces the electrical energy supplied to the electronic circuit 22. The other type of power supply 30 includes an electronic circuit for converting alternating current into direct current that it then supplies to the electronic circuit 22. Thus this second type of power supply 30 must be continuously supplied with electrical energy from an alternating current electrical power source. (Not depicted in FIG. 1.) In time, the ordinary battery type of power supply 30 will ultimately fail to energize the electronic circuit 22 when any one of the reactants required for its electro-chemical reaction is consumed. Alternatively, the second type of power supply 30 can fail to energize the electronic circuit 22 either due to the failure of its alternating current to direct current converting circuit, or because the power supply 30 becomes disconnected from its source of alternating current electrical power, or due to a component failure within the smoke alarm 10.

In battery power models of the smoke alarm 10, the electronic circuit 22 also includes a battery power monitoring circuit. (Not depicted separately.) If battery power becomes excessively low, the electronic circuit 22 automatically produces a signal which sounds the audible alarm 34 to alert the occupants to the existence of the low battery power condition.

Also included in the smoke alarm 10 in accordance with the present invention is a field effect transistor ("FET") electronic switch 50 having source and drain electrodes 52 and 54. The source electrode 52 of the FET switch 50 is connected to the circuit ground of the smoke alarm 10 while the other drain electrode 54 is connected through a resistor 56 to the sensor 20. Upon the application of an appropriate electrical signal to a gate electrode 58 of the FET switch 50, the FET switch 50 electrically interconnects the sensor 20 to circuit ground analogous to pressing the manual test switch 40. Thus applying an appropriate electrical signal to the gate electrode 58 generates a test electronic signal that simulates an excessive concentration of combustion products about the sensor 20 in the same manner as pressing the manual test switch 40. While the preferred embodiment of the smoke alarm 10 of the present invention includes the FET switch 50, there are other types of electronic circuit components that can be analogously activated by an electronic signal to perform the same switching function as that provided by the FET switch 50. One example of an electronically activatable switch that could be used instead of the FET switch 50 is an electro-mechanical relay.

To electronically control the operation of the FET switch 50, the smoke alarm 10 includes a test timing circuit 60. An output 62 of the test timing circuit 60 is connected to the gate electrode 58 of the FET switch 50 through a resistor 64. Similar to the electronic circuit 22, the test timing circuit 60 is energized by direct current supplied from the power supply 30 through power leads 66. Periodically, the test timing circuit 60 transmits a testing pulse from its output 62 to activate the FET switch 50 and thereby test the operation of the smoke alarm 10. An optional alarm operation feedback lead 68 connects the electronic circuit 22 to the test timing circuit 60 to provide an electronic feedback signal to the test timing circuit 60 each time the audible alarm 34 sounds. In the preferred embodiment of the smoke alarm 10, such test soundings occur at weekly intervals and last precisely for an interval of 3 seconds.

FIG. 2 depicts a first embodiment of the test timing circuit 60 of the present invention. The embodiment of the test timing circuit 60 depicted in FIG. 2 includes a crystal controlled oscillator 610. The crystal controlled oscillator 610 has an output 612 from which it transmits periodic timing pulses having a frequency of 32,768 Hz. Thus the frequency of the periodic timing pulses generated by the crystal controlled oscillator 610 is much higher than the once per week frequency at which the test timing circuit 60 transmits the testing pulse from its output 62.

The test timing circuit 60 also includes a digital counter 620 that receives the periodic timing pulses from the output 612 of the crystal controlled oscillator 610. In response to these periodic timing pulses, the digital counter 620 generates and transmits a test time signal from an output 622. To provide weekly testing of the smoke alarm 10, the digital counter 620 counts 19,818,086,400 periodic timing pulses between each occurrence of the test time signal.

An output test pulse generator 630 receives the test time signal from the output 622 of the digital counter 620. In response to the test time signal, the output test pulse generator 630 commences generation of the testing pulse which the test timing circuit 60 transmits from its output 62 to the gate electrode 58 of the FET switch 50. Since sounding of the audible alarm 34 occurs asynchronously from the operation of the digital counter 620, the output test pulse generator 630 receives a feedback signal from the electronic circuit 22 via the alarm operation feedback lead 68. Receipt of this feedback signal by the output test pulse generator 630 indicates that the audible alarm 34 has begun to sound and starts the 3 second interval for which the output pulse from the output test pulse generator 630 sounds the audible alarm 34.

Various different electronic circuits can be used for the output test pulse generator 630. Thus the output test pulse generator 630 could be built using a monostable multivibrator that produces one 3 second pulse for each occurrence of the test time signal. Alternatively, the output test pulse generator 630 could be built using digital logic circuitry that would produce the 3 second long testing pulse by combining two or more digital logic signals from various stages in the digital counter 620.

The crystal controlled oscillator 610, digital counter 620, and output test pulse generator 630 of the test timing circuit 60 depicted in FIG. 2 are all energized by direct current supplied thereto via a direct current lead 660 included in the power leads 66. Thus, in battery powered models of the smoke alarm 10, the battery power monitoring circuit included in the electronic circuit 22 will simultaneously monitor the electrical power supplied to both the electronic circuit 22 and the test timing circuit 60.

The test timing circuit 60 depicted in FIG. 2 can be used in the smoke alarm 10 regardless of which type of power supply 30 is included therein. Thus the test timing circuit 60 of FIG. 2 can be used with either a battery or an alternating current power supply 30. However, for a smoke alarm 10 having an alternating current power supply 30, there exists a simpler test timing circuit 60.

FIG. 3 depicts a second embodiment of the test timing circuit 60 of the present invention that is simpler than the one disclosed in the first embodiment. Those elements of the one depicted in FIG. 3 common to the test timing circuit 60 depicted in FIG. 2 carry the same reference numeral distinguished by a prime designation. In the simpler test timing circuit 60 of FIG. 3, a pulse generation circuit 670 receives an alternating current timing signal from the power supply 30 via an alternating current lead 672. The frequency of this alternating current timing signal supplied via the alternating current lead 672 is controlled by the alternating current power source that continuously supplies electrical power to the power supply 30. An electronic circuit, such as a Schmitt trigger and/or a low pass filter to remove extraneous pulses from the power line, is included in the pulse generation circuit 670 to produce the periodic timing pulses in response to this alternating current timing signal. Thus, the periodic timing pulses produced by the alternative embodiment pulse generation circuit 670 have the same frequency as the alternating current timing signal and are transmitted from the output 612' of the pulse generation circuit 670 to the digital counter 620' generally at a frequency of 50 or 60 Hz or alternatively 100 or 120 Hz. As with the embodiment depicted in FIG. 2, this frequency for the periodic timing pulses generated by the pulse generation circuit 670 is much higher than the once per week frequency at which the test timing circuit 60 transmits the testing pulse from its output 62.

Because the periodic timing pulses produced by the alternative embodiment pulse generation circuit 670 have a frequency much lower than that produced by the crystal controlled oscillator 610, the digital counter 620' included in the test timing circuit 60 depicted in FIG. 3 counts many fewer periodic timing pulses between each test time signal that it generates. To provide weekly testing of the smoke alarm 10 for periodic timing pulses having a frequency of 60 Hz, the digital counter 620' counts 36,288,000 periodic timing pulses between each occurrence of the test time signal.

To permit setting the time of day and day of the week at which the smoke alarm 10 automatically tests its operation, the digital counters 620 and 620' are designed to be reset when power is first applied to the smoke alarm 10. Alternatively, a separate manual timer reset button could be provided. Shortly after being reset, for example 8 seconds after being reset, the digital test pulse generator 630 and 630' in both embodiments transmit the test time signal from their respective outputs. Thus the smoke alarm 10 sounds its audible alarm 34 shortly after an occupant installs the battery in a battery powered smoke alarm 10 or plugs in an alternating current powered smoke alarm 10. Thus, an occupant knows that the smoke alarm 10 is operating properly shortly after it is energized. Subsequently, every week at the same time of day the alarm automatically tests itself and sounds its audible alarm 34 thereby reminding the occupant of the presence of the smoke alarm 10 and informing the occupant that the smoke alarm 10 is still operating properly.

FIG. 4 depicts a alternative embodiment of the smoke alarm 10 of the present invention which periodically reminds occupants to manually test the operation of the smoke alarm 10 rather than automatically testing such operation itself. Those elements of the embodiment depicted in FIG. 4 common to the smoke alarm 10 depicted in FIG. 1 carry the same reference numeral distinguished by a double prime designation. Because the embodiment of FIG. 4 does not automatically test its operation, it omits the FET switch 50 included in the embodiment depicted in FIG. 1 and the other electrical components associated therewith. Accordingly, in the embodiment of FIG. 4 the pulse transmitted from the output 62" of the test timing circuit 60" is applied directly to the electronic circuit 22" via a remind signal lead 680 rather than to the FET switch 50 omitted from this embodiment. (The test timing circuit 60" included in the smoke alarm 10" depicted in FIG. 4 may be either of the two types described above.) Application of the pulse from the test timing circuit 60" to the electronic circuit 22" merely causes the audible alarm 34" to sound. For this embodiment, it is intended that upon hearing the audible alarm 34" sound, the occupant will then remember to manually press the manual test switch 40" thereby testing the alarm.

While for the pedagogical reason of describing the present invention the FET switch 50 has been disclosed as being separate from the test timing circuit 60, in the preferred embodiment both the test timing circuit 60 and 60" are custom integrated circuits. Accordingly, to reduce manufacturing costs, the FET switch 50 is actually included within the integrated circuit test timing circuit 60.

Although the present invention has been described in terms of the presently preferred embodiments, it is to be understood that such disclosure is purely illustrative and is not to be interpreted as limiting. For example, a smoke alarm 10 or smoke alarm 10" in accordance with the present invention might sound its audible alarm 34 at daily, biweekly, or quad-weekly intervals rather than the weekly interval of the preferred embodiments. Analogously, the audible alarm 34 might sound for an interval shorter or longer than 3 seconds. For example it might sound for 2 seconds. Similarly, at each daily, weekly, biweekly, or quad-weekly sounding of the audible alarm 34, it might sound repetitively 2 or more times with a silent pause between successive pairs of soundings. Consequently, without departing from the spirit and scope of the invention, various alterations, modifications, and/or alternative applications of the invention will, no doubt, be suggested to those skilled in the art after having read the preceding disclosure. Accordingly, it is intended that the following claims be interpreted as encompassing all alterations, modifications, or alternative applications as fall within the true spirit and scope of the invention.

What is claimed is:

1. In a combustion products detector having sensor means that produces an electronic signal indicative of the concentration of combustion products present in the atmosphere surrounding the sensor means, electronic circuit means responsive to the electronic signal from the sensor means that produces an output electronic signal when the concentration of combustion products about the sensor means exceeds a pre-established level, alarm means responsive to the output electronic signal from the electronic circuit means that produces a perceptible indication when the concentration of combustion products about the sensor means exceeds the pre-established level, and power supply means that provides electrical power to energize said detector the improvement which comprises:

electronically activatable switch means, coupled to the sensor means, for generating a test electronic signal transmitted by the sensor means to the electronic circuit means to simulate a concentration of combustion products about the sensor means exceeding the pre-established level; and test timing means, coupled to said electronically activatable switch means, for periodically generating and transmitting a test pulse to said electronically activatable switch means to activate said switch means thereby causing the test electronic signal to be transmitted at periodic time intervals established by said test timing means, whereby in response thereto the alarm means periodically produces a test perceptible indication that the concentration of combustion products about the sensor means exceeds the pre-established level at time intervals established by said test timing means.

2. The improved combustion products detector of claim 1 wherein each successive testing pulse is generated by said test timing means at an interval such that the test perceptible indications produced by the alarm means occur at about daily intervals.

3. The improved combustion products detector of claim 1 wherein each successive testing pulse is generated by said test timing means at an interval such that the test perceptible indications produced by the alarm means occur at about weekly intervals.

4. The improved combustion products detector of claim 1 wherein each successive testing pulse is generated by said test timing means at an interval such that the test perceptible indications produced by the alarm means occur at about biweekly intervals.

5. The improved combustion products detector of claim 1 wherein each successive testing pulse is generated by said test timing means at an interval such that the test perceptible indications produced by the alarm means occur at about quad-weekly intervals.

6. The improved combustion products detector of claim 1 wherein each successive testing pulse generated by said test timing means has a duration such that the test perceptible indication has a duration of between 1 and 5 seconds.

7. The improved combustion products detector of claim 1 wherein a first testing pulse is generated by said test timing means within ten minutes after said test timing means is initially energized by the power supply means.

8. The improved combustion products detector of claim 1 wherein said test timing means includes:

periodic timing pulse generator means for producing and transmitting periodic timing pulses having a frequency that is higher than the frequency of the testing pulses generated by said test timing means;

counter means, which receives and responds to the periodic timing pulses transmitted by said periodic timing pulse generator means, for counting said periodic timing pulses and in response to the count thereof repetitively and periodically producing and transmitting test time signals at the same frequency as the testing pulses generated by said test timing means; and output test pulse generator means which receives the test time signals transmitted by said counter means and in response thereto generates the testing pulses which said test timing means transmits to said electronically activatable switch means.

9. The improved combustion products detector of claim 8 wherein each successive test time signal is generated by said counter means at an interval such that the test perceptible indications produced by the alarm means occur at about daily intervals.

10. The improved combustion products detector of claim 8 wherein each successive test time signal is generated by said counter means at an interval such that the test perceptible indications produced by the alarm means occur at about weekly intervals.

11. The improved combustion products detector of claim 8 wherein each successive test time signal is generated by said counter means at an interval such that the test perceptible indications produced by the alarm means occur at about biweekly intervals.

12. The improved combustion products detector of claim 8 wherein each successive test time signal is generated by said counter means at an interval such that the test perceptible indications produced by the alarm means occur at about quad-weekly intervals.

13. The improved combustion products detector of claim 8 wherein said periodic timing pulse generator means includes a crystal controlled oscillator whose frequency of oscillation determines the frequency of the periodic timing pulses produced by said periodic timing pulse generator means.

14. The improved combustion products detector of claim 13 wherein the periodic timing pulses produced by said periodic timing pulse generator means have a frequency of 32,768 Hz, and said counter means counts 19,818,086,400 periodic timing pulses between each successive test time signal produced by said counter means, whereby the alarm means repetitively produces the test perceptible indication that the concentration of combustion products about the sensor means exceeds the pre-established level at about weekly intervals.

15. The improved combustion products detector of claim 1 wherein said electronically activatable switch means is a semi-conductor switching device.

16. The improved combustion products detector of claim 15 wherein said test timing means includes:

periodic timing pulse generator means for producing and transmitting periodic timing pulses having a frequency that is higher than the frequency of the testing pulses generated by said test timing means;

counter means, which receives and responds to the periodic timing pulses transmitted by said periodic timing pulse generator means, for counting said periodic timing pulses and in response to the count thereof repetitively and periodically producing and transmitting test time signals at the same frequency as the testing pulses generated by said test timing means; and output test pulse generator means which receives the test time signals transmitted by said counter means and in response thereto generates the testing pulses which said test timing means transmits to said electronically activatable switch means.

17. The improved combustion products detector of claim 16 wherein said periodic timing pulse generator means includes a crystal controlled oscillator whose frequency of oscillation determines the frequency of the periodic timing pulses produced by said periodic timing pulse generator means.

18. The improved combustion products detector of claim 17 wherein the periodic timing pulses produced by said periodic timing pulse generator means have a frequency of 32,768 Hz, and said counter means counts 19,818,086,400 periodic timing pulses between each successive test time signal produced by said counter means, whereby the alarm means repetitively produces the test perceptible indication that the concentration of combustion products about the sensor means exceeds the pre-established level at about weekly intervals.

19. In a combustion products detector having sensor means that produces an electronic signal indicative of the concentration of combustion products present in the atmosphere surrounding the sensor means, electronic circuit means responsive to the electronic signal from the sensor means that produces an output electronic signal when the concentration of combustion products about the sensor means exceeds a pre-established level, alarm means responsive to the output electronic signal from the electronic circuit means that produces a perceptible indication when the concentration of combustion products about the sensor means exceeds the pre-established level, and power supply means that provides electrical power to energize said detector, the improvement which comprises:

reminder timing means, coupled to said electronic circuit means, for generating and transmitting a periodic reminding pulse to said electronic circuit means whereby in response thereto the alarm means produces a reminder perceptible indication at time intervals established by said reminder timing means, said reminder timing means including a crystal controlled oscillator for determining the frequency of the periodic reminding pulse.

20. In a combustion products detector having sensor means that produces an electronic signal indicative of the concentration of combustion products present in the atmosphere surrounding the sensor means, electronic circuit means responsive to the electronic signal from the sensor means that produces an output electronic signal when the concentration of combustion products about the sensor means exceeds a pre-established level, alarm means responsive to the output electronic signal from the electronic circuit means that produces a perceptible indication when the concentration of combustion products about the sensor means exceeds the pre-established level, and power supply means that provides electrical power to energize said detector, the improvement which comprises:

reminder timing means, coupled to said electronic circuit means, for generating and transmitting a periodic reminding pulse to said electronic circuit means whereby in response thereto the alarm means produces a reminder perceptible indication at time intervals established by said reminder timing means, said reminder timing means also having means for generating the first reminding pulse within ten minutes after said reminder timing means is initially energized by the power supply means.

21. In a combustion products detector having sensor means that produces an electronic signal indicative of the concentration of combustion products present in the atmosphere surrounding the sensor means, electronic circuit means responsive to the electronic signal from the sensor means that produces an output electronic signal when the concentration of combustion products about the sensor means exceeds a pre-established level, alarm means responsive to the output electronic signal from the electronic circuit means that produces a perceptible indication when the concentration of combustion products about the sensor means exceeds the pre-established level, and power supply means that provides electrical power to energize said detector, the improvement which comprises:

electronically activatable switch means, coupled to the sensor means, for generating a test electronic signal transmitted by the sensor means to the electronic circuit means to simulate a concentration of combustion products about the sensor means exceeding the pre-established level; and test timing means, coupled to said electronically activatable switch means, for generating and transmitting a periodic testing pulse to said electronically activatable switch means to activate said switch means thereby causing the test electronic signal to be transmitted at periodic time intervals established by said test timing means, whereby in response thereto the alarm means produces a test perceptible indication that the concentration of combustion products about the sensor means exceeds the pre-established level at time intervals established by said timing means, said test timing means including a crystal controlled oscillator for determining the frequency of the periodic testing pulse.

22. In a combustion products detector having sensor means that produces an electronic signal indicative of the concentration of combustion products present in the atmosphere surrounding the sensor means, electronic circuit means responsive to the electronic signal from the sensor means that produces an output electronic signal when the concentration of combustion products about the sensor means exceeds a pre-established level, alarm means responsive to the output electronic signal from the electronic circuit means that produces a perceptible indication when the concentration of combustion products about the sensor means exceeds the pre-established level, and power supply means that provides electrical power to energize said detector, the improvement which comprises:

electronically activatable switch means, coupled to the sensor means, for generating a test electronic signal transmitted by the sensor means to the electronic circuit means to simulate a concentration of combustion products about the sensor means exceeding the pre-established level; and test timing means, coupled to said electronically activatable switch means, for generating and transmitting a periodic testing pulse to said electronically activatable switch means to activate said switch means thereby causing the test electronic signal to be transmitted at time intervals established by said test timing means, whereby in response thereto the alarm means produces a test perceptible indication that the concentration of combustion products about the sensor means exceeds the pre-established level at time intervals established by said timing means, said test timing means including a crystal controlled oscillator for determining the frequency of the periodic testing pulse, said test timing means also having means for generating the first testing pulse within ten minutes after said test timing means is initially energized by the power supply means.

23. A combustion products detector comprising:

sensor means for producing an electronic signal indicative of the concentration of combustion products present in the atmosphere surrounding said sensor means;

detector responsive to the electronic signal from said sensor means for producing an output electronic signal when the concentration of combustion products about said sensor means exceeds a pre-established level;

alarm means responsive to the output electronic signal from said electronic circuit means for producing a perceptible indication when the concentration of combustion products about the sensor means exceeds the pre-established level;

power supply means for providing electrical power to energize said electronic circuit means;

electronically activatable switch means, coupled to the sensor means, for generating a test electronic signal transmitted by the sensor means to the electronic circuit means to simulate that the concentration of combustion products about the sensor means exceeds the pre-established level; and test timing means, coupled to said electronically activatable switch means, for periodically generating and transmitting a testing pulse to said electronically activatable switch means to activate said switch means thereby causing the test electronic signal to be transmitted at periodic time intervals established by said test timing means, whereby in response thereto the alarm means periodically produces a test perceptible indication that the concentration of combustion products about the sensor means exceeds the pre-established level at time intervals established by said test timing means.

24. The combustion products detector of claim 23 wherein each successive testing pulse is generated by said test timing means at an interval such that the test perceptible indication produced by the alarm means occurs at about weekly intervals.

25. The combustion products detector of claim 23 wherein said test timing means includes:

periodic timing pulse generator means for producing and transmitting periodic timing pulses having a frequency that is higher than the frequency of the testing pulses generated by said test timing means;

counter means, which receives and responds to the periodic timing pulses transmitted by said periodic timing pulse generator means, for counting said periodic timing pulses and in response to the count thereof repetitively and periodically producing and transmitting test time signals at the same frequency as the testing pulses generated by said test timing means; and output test pulse generator means which receives the test time signals transmitted by said counter means and in response thereto generates the testing pulses which said test timing means transmits to said electronically activatable switch means.

26. The combustion products detector of claim 25 wherein each successive test time signal is generated by said counter means at an interval such that the test perceptible indications produced by the alarm means occur at about biweekly intervals.

27. In a combustion products detector having sensor means that produces an electronic signal indicative of the concentration of combustion products present in the atmosphere surrounding the sensor means, electronic circuit means responsive to the electronic signal from the sensor means that produces an output electronic signal when the concentration of combustion products about the sensor means exceeds a pre-established level, alarm means responsive to the output electronic signal from the electronic circuit means that produces a perceptible indication when the concentration of combustion products about the sensor means exceeds the pre-established level, and power supply means that provides electrical power to energize said electronic circuit means, the power supply means being continuously supplied with electrical power by an alternating current electrical power source, the improvement which comprises:

timing signal means coupled to the power supply means for transmitting an alternating current timing signal at a frequency controlled by the frequency of the alternating current electrical power source;

electronically activatable switch means, coupled to the sensor means, for generating a test electronic signal transmitted by the sensor means to the electronic circuit means to simulate a concentration of combustion products about the sensor means exceeding the pre-established level; and test timing means, coupled to said electronically activatable switch means, for periodically generating and transmitting a testing pulse to said electronically activatable switch means to activate said switch means thereby causing the test electronic signal to be transmitted at periodic time intervals established by said test timing means, whereby in response thereto the alarm means periodically produces a test perceptible indication that the concentration of combustion products about the sensor means exceeds the pre-established level at time intervals established by said test timing means, said test timing means including:

periodic timing pulse generator means for producing and transmitting periodic timing pulses having a frequency that is higher than the frequency of the testing pulses generated by said test timing means, said periodic timing pulse generator means having a pulse generation circuit that receives the alternating current timing signal transmitted by the power supply means and produces the periodic timing pulses in response thereto;

counter means, which receives and responds to the periodic timing pulses transmitted by said periodic timing pulse generator means, for counting said periodic timing pulses and in response to the count thereof repetitively and periodically producing and transmitting test time signals at the same frequency as the testing pulses generated by said test timing means; and output test pulse generator means which receives the test time signals transmitted by said counter means and in response thereto generates the testing pulses which said test timing means transmits to said electronically activatable switch means.

28. The improved combustion products detector of claim 27 wherein the periodic timing pulses produced by the periodic timing pulse generator means in response to the alternating current electrical power source have a frequency of 60 Hz, and said counter means counts 36,288,000 periodic timing pulses between each successive test time signal produced by said counter means, whereby the alarm means repetitively produces the test perceptible indication that the concentration of combustion products about the sensor means exceeds the pre-established level at about weekly intervals.

29. The improved combustion products detector of claim 27 wherein the periodic timing pulses produced by the periodic timing pulse generator means in response to the alternating current electrical power source have a frequency of 120 Hz, and said counter means counts 72,576,000 periodic timing pulses between each successive test time signal produced by said counter means, whereby the alarm means repetitively produces the test perceptible indication that the concentration of combustion products about the sensor means exceeds the pre-established level at about weekly intervals.

30. The improved combustion products detector of claim 27 wherein said electronically activatable switch means is a semiconductor switching device.

31. The improved combustion products detector of claim 30 wherein the periodic timing pulses produced by the periodic timing pulse generator means in response to the alternating current electrical power source have a frequency of 60 Hz, and said counter means counts 36,288,000 periodic timing pulses between each successive test time signal produced by said counter means, whereby the alarm means repetitively produces the test perceptible indication that the concentration of combustion products about the sensor means exceeds the per-established level at about weekly intervals.

32. The improved combustion products detector of claim 30 wherein the periodic timing pulses produced by the periodic timing pulse generator means in response to the alternating current electrical power source have a frequency of 120 Hz, and said counter means counts 72,576,000 periodic timing pulses between each successive test time signal produced by said counter means, whereby the alarm means reptitively produces the test perceptible indication that the concentration of combustion products about the sensor means exceeds the pre-established level at about weekly intervals.

* * * * *